US006445303B1

(12) United States Patent
Aryeh

(10) Patent No.: US 6,445,303 B1
(45) Date of Patent: Sep. 3, 2002

(54) APPARATUS AND METHOD FOR PRODUCING AN ELECTRIC SHOCK TO WAKE SLEEPING DRIVERS

(76) Inventor: Michael Aryeh, 1020 Madison Ave., New York, NY (US) 10021

( * ) Notice: Subject to any disclaimer, the term of this patent is extended or adjusted under 35 U.S.C. 154(b) by 0 days.

(21) Appl. No.: 09/603,481

(22) Filed: Jun. 23, 2000

(51) Int. Cl.[7] ..... G08B 23/00
(52) U.S. Cl. ..... 340/575; 340/576; 180/272
(58) Field of Search ..... 340/575, 576, 340/573.3, 573.4, 503, 504, 505, 566; 180/272, 273, 274

(56) References Cited

U.S. PATENT DOCUMENTS 3,049,090 A * 8/1962 Bergen ..... 340/575
3,082,414 A * 3/1963 Papaminas ..... 340/575
5,353,013 A * 10/1994 Estrada ..... 340/575
5,857,433 A * 1/1999 Files ..... 340/573
5,877,849 A * 3/1999 Ramer ..... 340/575
6,016,103 A * 1/2000 Leavitt ..... 340/575
6,049,747 A * 4/2000 Nakajima ..... 701/45
6,079,367 A * 7/2000 Stapelfeld ..... 340/573.3
6,087,941 A * 7/2000 Ferraz ..... 340/575

* cited by examiner

*Primary Examiner*—Anh La
(74) *Attorney, Agent, or Firm*—Jean-Marc Zimmerman

(57) ABSTRACT

An apparatus and method for waking a sleeping driver of a motor vehicle to prevent the driver from causing an accident by administering an electric shock to the driver. The invention determines whether a driver has fallen asleep by either monitoring the driver's pulse, the orientation and position of the driver's head with respect to at least two planes of movement, or the movement of the driver's eyes. The electric shock can be administered by an element integrated in or coupled to the vehicle steering wheel, or by an element worn by the driver or secured to the driver's clothing.

8 Claims, 2 Drawing Sheets

APPARATUS AND METHOD FOR PRODUCING AN ELECTRIC SHOCK TO WAKE SLEEPING DRIVERS

FIELD OF THE INVENTION

This present invention pertains to alarms, and more particularly to a device for wake a sleeping driver.

BACKGROUND OF THE INVENTION

Motor vehicles such as cars and trucks are widely used throughout the United States for pleasure and commerce. As the number of vehicles which travel on the nation's roadways continues to increase, so does the threat posed to the safety of these roadways by drivers who fall asleep at the wheel and cause accidents which maim and kill large numbers of people every year. Such accidents, which often occur early in the morning and late at night, are typically caused by drivers who have driven long distances and fallen asleep due to the boredom and fatigue associated with such drives. Various devices have been developed to wake sleeping drivers to prevent them from causing accidents. Examples of such devices are described below.

U.S. Pat. No. 4,210,905 to Coons discloses a plurality of electrical switches symmetrically arranged around a steering wheel of a vehicle. A rigid member extends continuously about the steering wheel and is resiliently attached thereto. The rigid member is operatively arranged with respect to the plurality of switches so that a normal grasp of the steering wheel causes the rigid member to be displaced and at least one switch of the plurality of switches to change from its normal position. An alarm means is electrically connected to the plurality of switches and a power supply so that an alarm is given if all switches of the plurality are in their normal position. Thus when a driver grasps the steering wheel and causes at least one of the switches to change from its normal position no alarm occurs. If, on the other hand, the driver loosens his grip on the steering wheel so that all switches are in their normal position, an alarm is given to awaken the driver if he or she has fallen asleep.

U.S. Pat. No. 4,361,834 to King discloses a safety alarm device adapted to be worn on the user's hand for providing a visible, audible or tactile alerting signal when as a result of drowsiness the user's hand relaxes.

U.S. Pat. No. 5,353,013 to Estrada discloses an alarm system for warning a driver of a vehicle that he or she is falling asleep. An alarm module which includes an optical beam emitter and receiver directed toward the head of the driver is mounted in the cabin of the vehicle, preferably above the driver's seat. A reflector is provided to be worn on the head of the driver, either on a hat, cap, headband, or the like. The emitter and receiver system is arranged so that a head position associated with loss of wakefulness causes the alarm system to emit a loud warning to awaken the driver.

U.S. Pat. No. 6,016,103 to Leavitt discloses sleep-detecting driving gloves having strategically placed pressure sensors in the lining of the glove, wherein a driver's grasp force on the steering wheel is monitored and an alarm system is activated when pressure readings fall outside of accepted range to awaken the driver who may have fallen asleep.

Conventional devices of the type just described suffer from several drawbacks. Typically, the means employed by such devices to wake sleeping drivers, i.e., principally sound, are not very effective in waking sleeping drivers. Accordingly, there is a need for a more effective device.

SUMMARY

An apparatus and method for producing a low current, electric shock to wake a sleeping driver to prevent the driver from causing an accident, wherein the electric shock is transmitted via the steering wheel held by the driver. Alternatively, the device can transmit the electronic shock via an element worn on the driver's body or secured to an article of clothing worn by the driver. The device is programmable so that it can be set to shock the driver at a predetermined frequency and current for a predetermined period of time.

DETAILED DESCRIPTION OF THE INVENTION

Figure 1:
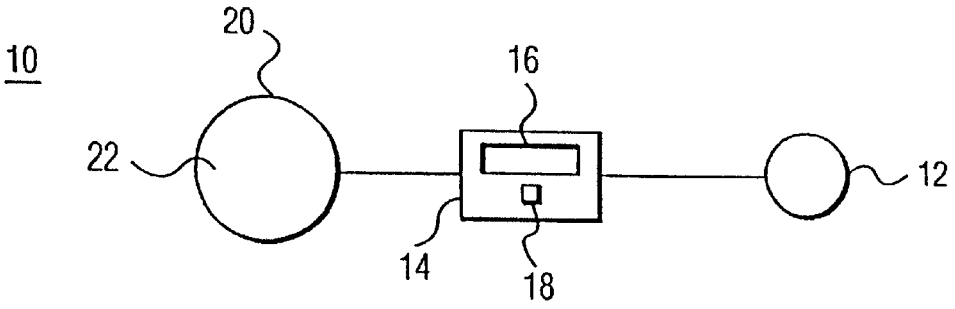
FIG. 1 shows a perspective view of a first exemplary embodiment of a device for producing an electric shock to wake a sleeping driver according to the present invention.

FIG. 1 shows a first exemplary embodiment of a device 10 for producing an electric shock to wake a sleeping driver of a motor vehicle according to the present invention. Device 10 is comprised of a sensor 12 which senses the driver's pulse and is worn around one of the driver's wrists. Sensor 12 is coupled to a monitor 14 that monitors the driver's pulse. Monitor 14 includes a display window 16 and at least one control button 18 for programming and operating device 10. Monitor 14 is coupled to a shocking element 20 that is fabricated as part of or is coupled to a vehicle steering wheel 22. When monitor 14 senses that the driver's pulse indicates that the driver has fallen asleep, it causes shocking element 20 to produce a low current, electric shock to wake the sleeping driver and prevent the driver from causing an accident.

The duration (period of time during which an electric shock is administered), frequency (number of electrical shocks administered in a given time period) and strength (the amount of current of the electrical shock) of the low current, electric shock administered by shocking element 20 can be selectively controlled using control button 18. The selected settings for the duration, frequency and strength of the electric shock are displayed in display window 16. The strength of the electric shock administered to the driver is not harmful and is thus not life-threatening. For example, the electric shock can be selected to be of the same strength as the shock a person would receive if they touched a child's electric train set that was turned on.

Device 10 can be fabricated as an integrated part of a vehicle or it can be an aftermarket item that is installed after the vehicle is purchased. Also, sensor 12 can be worn around one of the driver's fingers or coupled to one of the driver's ears. In an alternative embodiment of the present invention, the electric shock can be administered by an element worn by the driver, such as bracelet or a ring, or by an element secured to an article of clothing worn by the driver, such as a clip.

Figure 2:
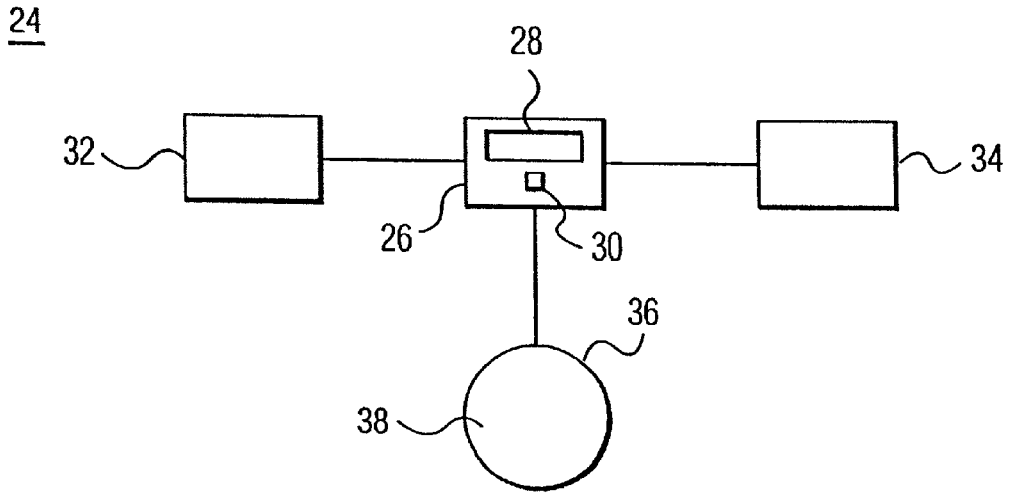
FIG. 2 shows a perspective view of a second exemplary embodiment of a device for producing an electric shock to wake a sleeping driver according to the present invention.

FIG. 2 shows a second exemplary embodiment of a device 24 for producing an electric shock to wake a sleeping driver of a motor vehicle according to the present invention. Device 24 is comprised of a control panel 26 that includes a display window 28 and at least one control button 30 for programming and operating device 24, and two light source/monitors 32 and 34 which are positioned in the interior of the vehicle and are coupled to control panel 26. Light source/monitors 32 and 34 project light beams, such as infrared beams, in two dimensions, i.e., the x and y planes of movement, towards the driver's head to monitor the orientation and position of a driver's head with respect to the x-y plane.

Control panel 26 is coupled to a shocking element 36 that is fabricated as part of or is coupled to a vehicle steering wheel 38. Light source/monitors 32 and 34 cause shocking element 36 to produce a low current, electric shock to wake the sleeping driver and prevent the driver from causing an accident when the orientation and position of the driver's head has moved with respect to the two dimensional plane in a manner indicating that the driver has fallen asleep, such as the driver's head slumping to the side and resting on his or her shoulder, or the driver's head slumping forward or backward.

The duration, frequency and strength of the low current, electric shock in administered by shocking element 36 can be selectively controlled using control button 30. The selected settings for the duration, frequency and strength of the electrical shock are displayed in display window 28. Device 24 can be fabricated as an integrated part of a vehicle or it can be an after-market item that is installed after the vehicle is purchased. Also, control panel 26 can be fabricated as part of either light source/monitor 32 and/or 34. In an alternative embodiment of the present invention, a third light source/monitor can be used to project a third light beam towards the driver's head and monitor the orientation and position of the driver's head with respect to a third plane of movement, i.e., the z plane. In still another alternative embodiment of the present invention, a single light source/monitor can be used to project two or three light beams in two or three planes of movement, respectively, and monitor the orientation and position of the driver's head with respect to the same. In yet another alternative embodiment of the present invention, the electric shock can be administered by an element worn by the driver, such as bracelet or a ring, or by an element coupled to an article of clothing worn by the driver, such as a clip.

Figure 3:
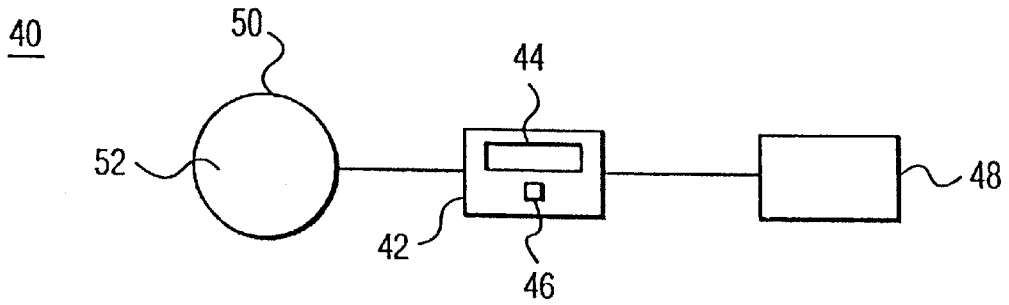
FIG. 3 shows a perspective view of a third exemplary embodiment of a device for producing an electric shock to wake a sleeping driver according to the present invention.

FIG. 3 shows a third exemplary embodiment of a device 40 for producing an electric shock to wake a sleeping driver of a motor vehicle according to the present invention. Device 40 is comprised of a control panel 42 that includes a display window 44 and at least one control button 46 for programming and operating device 40, and a light source/monitor 48 that is coupled to control panel 42 and is adjustably positioned on the vehicle windshield or a vehicle window. Light source/monitor 48 both projects a light beam, such as an infrared beam, into the eyes of the driver and monitors the movement of the driver's eyes. Control panel 42 is coupled to a shocking element 50 that is fabricated as part of or is coupled to a vehicle steering wheel 52. Light source/monitor 48 causes shocking element 50 to produce a low current, electric shock to wake the sleeping driver and prevent the driver from causing an accident when light source/monitor 48 senses from the driver's eye movements, or lack thereof, that the driver has fallen asleep.

The duration, frequency and strength of the low current, electric shock administered by shocking element 50 can be selectively controlled using control button 46. The selected settings for the duration, frequency and strength of the electrical shock are displayed in display window 44. Device 40 can be fabricated as an integrated part of a vehicle or it can be an after-market item that is installed after the vehicle is purchased. Also, control panel 42 can be fabricated as part of light source/monitor 48. In an alternative embodiment of the present invention, the electric shock can be administered by an element worn by the driver, such as bracelet or a ring, or by an element coupled to an article of clothing worn by the driver, such as a clip.

Figure 4:
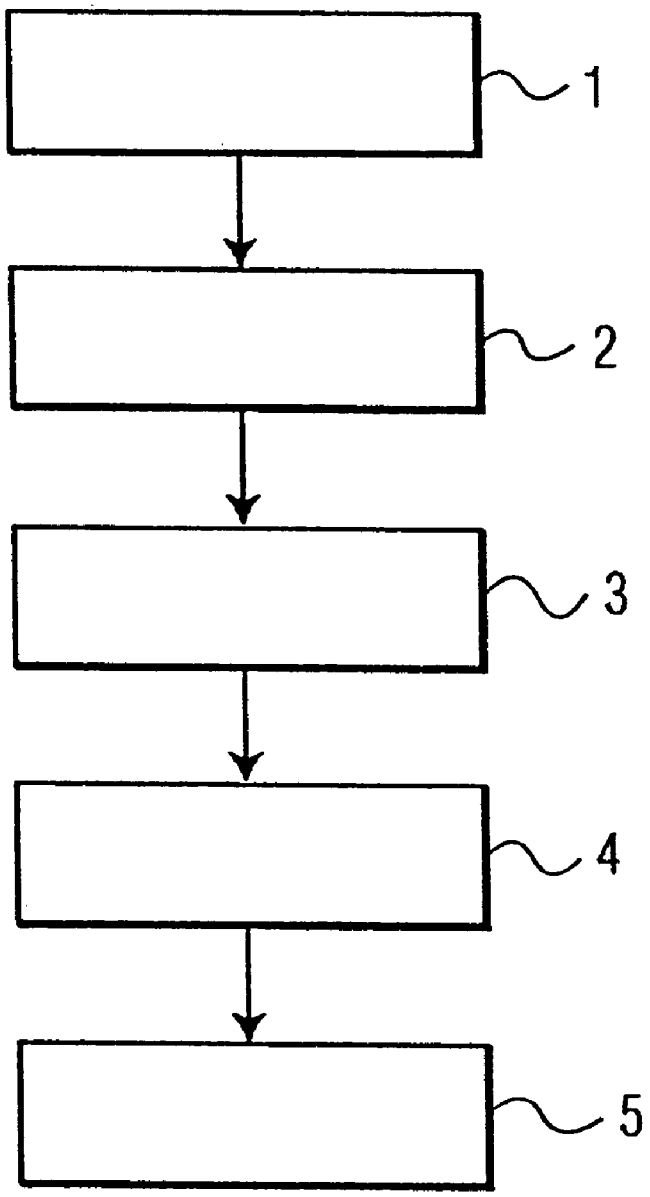
FIG. 4 shows a flow chart detailing the steps by which the present invention operates to wake a sleeping driver according to the present invention.

FIG. 4 shows a flowchart depicting the operation of devices 10, 24 and 40. At step 1, a driver uses control button 18, 30 or 46 to select the duration of the low current, electric shock to be administered if he or she falls asleep. At step 2, the driver uses control button 18, 30 or 46 to select the frequency of the low current, electric shock to be administered if he or she falls asleep. At step 3, the driver uses control button 18, 30 or 46 to select the strength of the low current, electric shock to be administered if he or she falls asleep. At step 4, the driver uses control button 18, 30 or 46 to activate device 10, 24 or 40, respectively. At step 5, the driver uses control button 18, 30 or 46 to turn device 10, 24 or 40, respectively, off when it administers a shock to the driver. Alternatively, the driver can use control button 18, 30 or 46 to stop the electrical shock being administered without turning off device 10, 24 or 40, respectively. Once steps 1 through 3 are performed for the first time and device 10, 24 or 40, respectively, is programmed, steps 1 through 3 need not be repeated to use device 10, 24 or 40 unless the driver wants to change the duration, frequency or strength of the electrical shock to be administered.

The various embodiments of the present invention can be used in any type of motor vehicle. Also, the various embodiments of the present invention are relatively inexpensive whether fabricated as an integrated part of a vehicle or as an after-market item, especially when measured against the cost of human lives that will be saved by using such invention. Also, the couplings between the elements of the different embodiments of the present invention described above can be hard wired or wireless. In addition, the light sources used in the embodiments described above can be of any type, i.e., visible, infrared, etc. The different embodiments of the present invention can also be used to wake persons other than drivers of motor vehicles who must remain awake and alert to supervise the performance of dangerous tasks but may fall asleep due to the boredom associated with such tasks, such as monitoring instrumentation in a power plant or monitoring instrumentation on an aircraft that is being flown by an auto pilot system.

Numerous modifications to and alternative embodiments of the present invention will be apparent to those skilled to the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claims is reserved.

What is claimed is:

1. A device for waking a sleeping driver of a motor vehicle, comprising:

a first light source/monitor for directing a first light source toward a head of a driver to monitor the orientation and position of the driver's head with respect to a first plane of movement;

a second light source/monitor coupled to the first light source/monitor for directing a second light source toward the driver's head to monitor the orientation and position of the driver's head with respect to a second plane of movement; and a shocking element coupled to the second light source/monitor for administering an electric shock to the driver when the first and second light source/monitors sense that the orientation and position of the driver's head has moved with respect to the two planes of movement in a manner indicating that the driver has fallen asleep to wake the driver and thus prevent the driver from causing an accident.

2. The device according to claim 1, wherein the shocking element is integrated in a vehicle steering wheel.

3. The device according to claim 1, wherein the shocking element is coupled to a vehicle steering wheel.

4. The device according to claim 1, wherein the shocking element is worn by the driver.

5. The device according to claim 1, wherein the shocking element is secured to the driver's clothing.

6. The device according to claim 1, wherein at least one of the first and second light source/monitors include a display window.

7. The device according to claim 1, wherein at least one of the first and second light source/monitors include at least one button for programming and operating the device.

8. The device according to claim 1, wherein the device can be programmed to deliver an electrical shock of a predetermined frequency and strength over a predetermined period of time.

* * * * *